US009556673B2

(12) United States Patent
Stover et al.

(10) Patent No.: US 9,556,673 B2
(45) Date of Patent: Jan. 31, 2017

(54) SAFETY GATE APPARATUS AND METHOD

(71) Applicants: Carl Lee Stover, Ostrander, OH (US); Craig T. Jones, Johnstown, OH (US); Dennis R. Weber, Delaware, OH (US)

(72) Inventors: Carl Lee Stover, Ostrander, OH (US); Craig T. Jones, Johnstown, OH (US); Dennis R. Weber, Delaware, OH (US)

(73) Assignee: Diverse Holdings, LLC, Delaware, OH (US)

( * ) Notice: Subject to any disclaimer, the term of this patent is extended or adjusted under 35 U.S.C. 154(b) by 0 days.

(21) Appl. No.: 14/453,594

(22) Filed: Aug. 6, 2014

(65) Prior Publication Data

US 2015/0040481 A1 Feb. 12, 2015

Related U.S. Application Data

(60) Provisional application No. 61/862,562, filed on Aug. 6, 2013.

(51) Int. Cl.
*E06B 11/00* (2006.01)
*E06B 11/02* (2006.01)
(Continued)

(52) U.S. Cl.
CPC ..... *E06B 11/00* (2013.01); *E04G 21/3223* (2013.01); *E05D 13/12* (2013.01); *E06B 11/025* (2013.01);
(Continued)

(58) Field of Classification Search
CPC ..... E06B 11/022; E06B 11/023; E06B 11/025; E06B 11/04; E06B 3/44; E06B 11/00; E01F 13/04; E01F 13/048; E05F 1/08; E05D 13/1207; E05D 13/123; E05D 13/10; E05D 13/12; E05D 15/16; B65G 67/02
(Continued)

(56) References Cited

U.S. PATENT DOCUMENTS 238,166 A * 2/1881 Shepard ..... 49/190
3,638,710 A * 2/1972 Sundermann ..... E06B 11/023 160/144
(Continued)

FOREIGN PATENT DOCUMENTS

DE 500044 * 6/1930 ..... E05D 13/1207
EP 1191150 A2 * 3/2002 ..... E01F 15/12
(Continued)

OTHER PUBLICATIONS

Machine Translation of FR2970719.*
Machine translation of DE500044.*

*Primary Examiner* — Katherine Mitchell
*Assistant Examiner* — Marcus Menezes
(74) *Attorney, Agent, or Firm* — Miracle IP; Bryce D. Miracle

(57) ABSTRACT

A safety gate apparatus is provided which couples as a cost efficient and reliable gate for preventing falls and injury as well as a gate that can easily be opened by existing equipment such as a fork lift. The invention comprises a vertical sliding gate configured to move in a path of motion having at least a closed position and an open position. The vertical sliding gate remains in a closed, default position by an applied counter force created by one more elastic means. The sliding gate slides down to an open position by a downward force created by a fork lift or other machinery. The gate will automatically return to the default position when the downward force is removed.

2 Claims, 12 Drawing Sheets

(51) Int. Cl.

| | |
|---|---|
| ***E05D 13/00*** | (2006.01) |
| ***E06B 11/04*** | (2006.01) |
| ***E04G 21/32*** | (2006.01) |
| *E06B 9/00* | (2006.01) |
| *E06B 9/01* | (2006.01) |

(52) U.S. Cl.
CPC ..... *E06B 11/04* (2013.01); *E05D 13/1207* (2013.01); *E05Y 2900/40* (2013.01); *E06B 2009/002* (2013.01); *E06B 2009/015* (2013.01)

(58) Field of Classification Search
USPC ..... 49/131
See application file for complete search history.

(56) References Cited

U.S. PATENT DOCUMENTS

| | | | | |
|---|---|---|---|---|
| 4,531,325 | A * | 7/1985 | Phillips | 49/49 |
| 5,400,721 | A * | 3/1995 | Greene | 108/147 |
| 6,227,523 | B1 * | 5/2001 | Haberlen | E01F 13/048 246/127 |
| 6,408,571 | B1 * | 6/2002 | Trott | 49/263 |
| 7,329,067 | B1 * | 2/2008 | Rodriguez | 404/6 |
| 8,955,265 | B1 * | 2/2015 | Harkrader | 52/173.2 |
| 2009/0260293 | A1 * | 10/2009 | Lough | 49/358 |

FOREIGN PATENT DOCUMENTS

| | | | | |
|---|---|---|---|---|
| EP | 1748106 | A1 * | 1/2007 | E01F 13/04 |
| FR | 2970719 | A1 * | 7/2012 | |

* cited by examiner

SAFETY GATE APPARATUS AND METHOD

CROSS RELATED REFERENCES

This application claims priority to the Provisional Patent Application No. 61/862,562 filed Aug. 6, 2013.

BACKGROUND

In industrial applications, mezzanine floor systems are semi-permanent floor systems typically installed within buildings, built between two permanent original stories. These structures are usually free standing and in most cases can be dismantled and relocated. Commercially sold mezzanine structures are generally constructed of steel, aluminum, and fiberglass.

Mezzanines are frequently used in industrial operations such as warehousing, distribution or manufacturing. These facilities have high ceilings, allowing unused space to be utilized within the vertical cube. Industrial mezzanine structures are typically either structural, roll formed, rack-supported, or shelf-supported, allowing high density storage within the mezzanine structure.

Mezzanines are often built without fall protection resulting in frequent accidents including serious injury and even death. Moreover, in order for fork lifts and other machinery to access and deliver and receive goods to and from a mezzanine level, an opening must be present within existing railing and barrier systems. There have been many attempts to try and solve this problem without any reliable, cost effective solution. For example, employees have been required to connect themselves by a cord or other connection means to part of the mezzanine structure, such that if they did fall the cord would prevent them from falling over the side of the mezzanine onto the floor below. However, this requires that the employee painstakingly follow through with connecting and disconnecting throughout each position on the mezzanine. This process of connecting and disconnecting requires substantial time and effort in order to properly follow through. Other varying gate and rail solutions have been tried without success such as duel interlock roll around gates, barn door style gates, or gates that swing open. However, these types of design are expensive and require more space, thus reducing the available storage. Moreover, electric hand rail systems have been tried, but have been found to be extremely costly and require an operator.

For the foregoing reason, there is a need for a method and apparatus that will provide a cost efficient, yet safe and reliable, easy to remove and operate fall protection for mezzanines and other platforms.

SUMMARY

In accordance with the invention, a safety gate apparatus is provided which couples as a cost efficient and reliable gate for preventing falls and injury as well as a gate that can easily be opened by existing equipment such as a fork lift. This provides a safe, low-cost, and time saving apparatus and method for preventing falls and keeping employees safe while on the platform.

The invention comprises a vertical sliding gate configured to move in a path of motion having at least a closed position and an open position. The vertical sliding gate remains in a closed, default position by an applied counter force created by one more elastic means. The sliding gate slides down to an open position by a downward force created by a fork lift or other machinery. The gate will automatically return to the default position when the downward force is removed.

A version of the safety gate apparatus and method comprises a gate assembly having a fixed vertical guidance assembly providing a vertical path of motion and a vertical sliding gate which slides within the vertical path of motion; and a counter force assembly for providing a resistive counter force opposite a downward force applied to the vertical sliding gate, the counter force assembly comprising a fixed counter force framework providing a vertical path of motion, a sliding counter force framework configured to operably slide within the path of motion provided by the fixed counter force framework, and one or more elastic means operably connecting the sliding counter force framework with the fixed counter force framework. The vertical sliding gate has a vertical path of motion from a default, closed position to an open position. The sliding counter force framework is operably connected to the vertical sliding gate. Accordingly, the vertical sliding gate and the sliding counter force framework move within their respective paths of motion concurrently. Whereby, the one or more springs provide a resistive counter force opposite a downward force applied to the vertical sliding gate, thus tending to return to the default, closed position when the application of downward force is removed.

In a version of the invention, the fixed counter force framework comprises a first elastic means connection member horizontally positioned within the framework and the sliding counter force framework comprises a second elastic means connection member horizontally positioned within the framework. The one or more elastic means operably connect to the first elastic means connection member and the second elastic means connection member. The first elastic means connection member and the second elastic means connection member provide the ability to selectively engage or disengage the one or more elastic means, whereby a user can selectively change the resistive counter force by engaging or disengaging one or more elastic means between the first elastic means connection member and the second elastic means connection member.

In another version, the safety gate apparatus further comprises a hydraulic dampener operably connecting the vertical sliding gate with the fixed spring framework, thereby providing a resistive force when the vertical sliding gate is moved downward through the path of motion or in the alternative providing a dampening resistive force when the vertical sliding gate is released moving back into the closed position.

In another version, the vertical sliding gate may further comprise one or more horizontally positioned fork lift rollers in order for a fork lift or other machinery to smoothly engage the vertical sliding gate prior to opening.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

Referring now to the figures wherein the showings are for purposes of illustrating a preferred version of the invention only and not for purposes of limiting the same, the present invention is a vertical sliding gate which provides a safe, ergonomic safety barrier for preventing falls and injury as well as a gate that can easily be opened by existing equipment such as a fork lift by the application of a downward force. The disclosure of U.S. Provisional Patent Application No. 61/862,562 is hereby incorporated in its entirety.

The following detailed description is of the best currently contemplated modes of carrying out exemplary versions of the invention. The description is not to be taken in the limiting sense, but is made merely for the purpose illustrating the general principles of the invention, since the scope of the invention is best defined by the appended claims.

Various inventive features are described below that can each be used independently of one another or in combination with other features.

Figure 1:
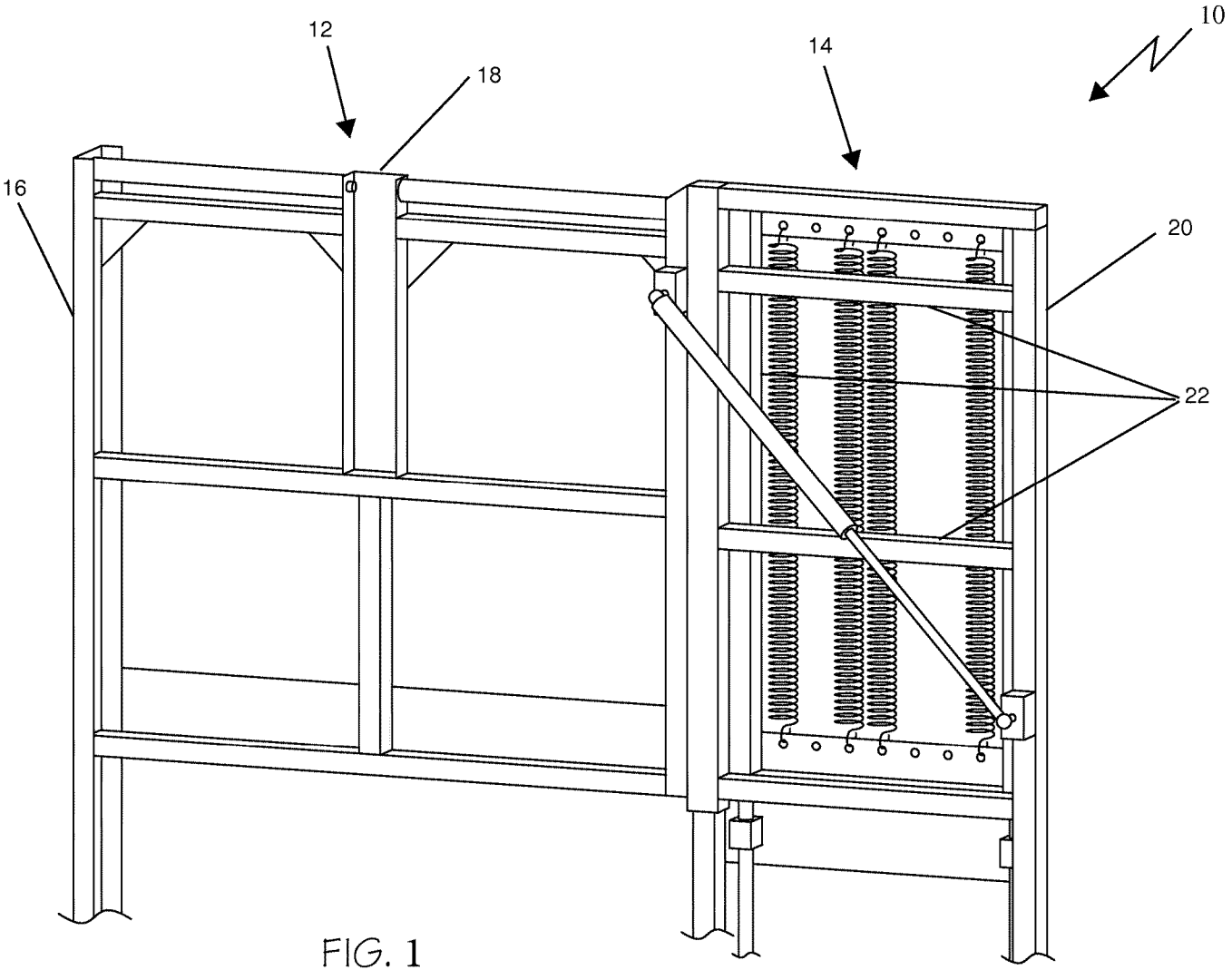
FIG. 1 is a front perspective view of a version shown in the default, closed position.
Figure 2:
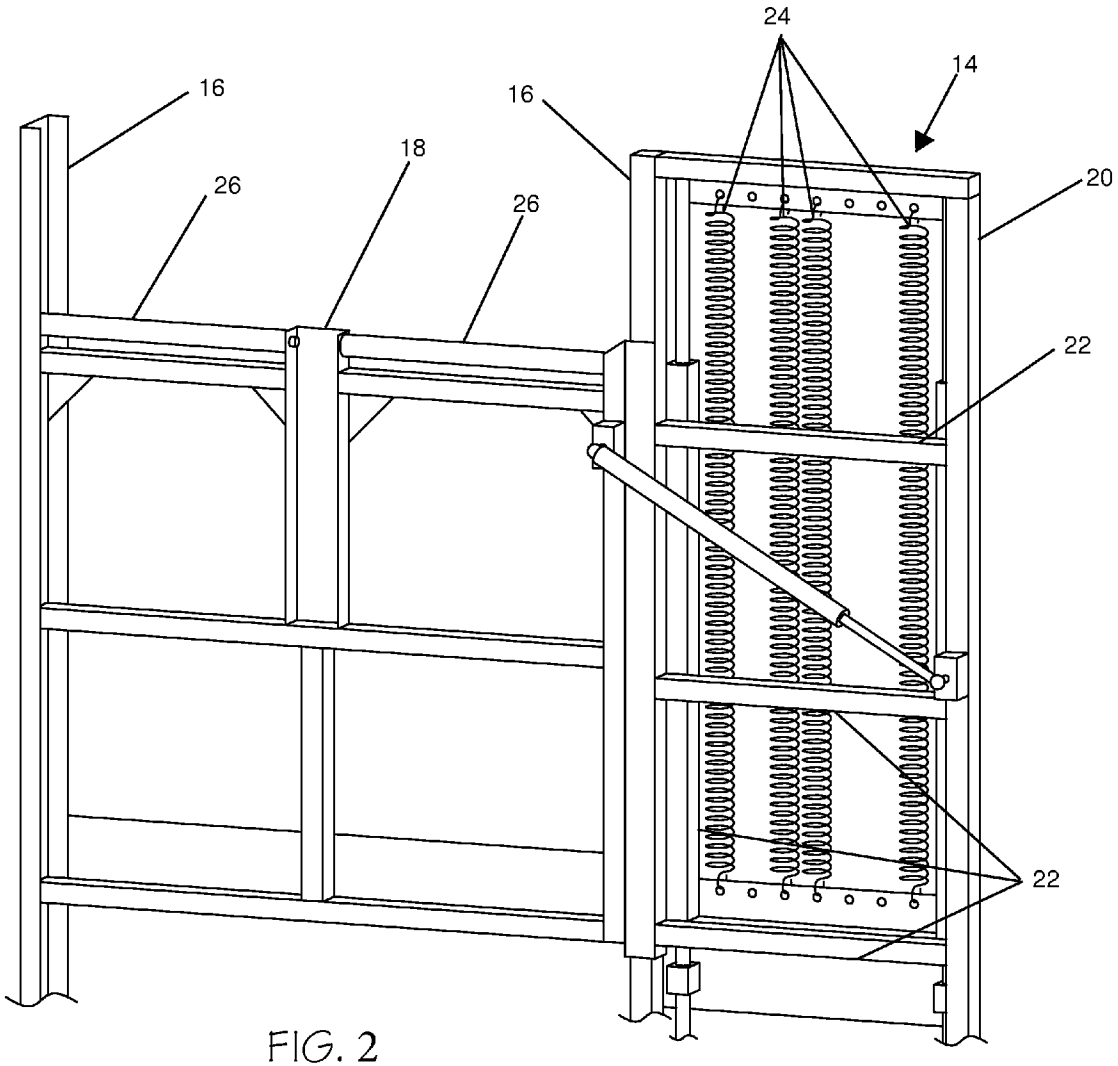
FIG. 2 is a front perspective view of a version shown in the open, downward position.

With reference to FIG. 1 and FIG. 2, a description of a version of the invention will be provided. FIG. 1 is an illustrative view showing version 10 in the default, closed position. The version 10 of the invention comprises a gate assembly 12 comprising a fixed vertical guidance framework 16 and a vertical sliding gate 18; and a counter force assembly 14 comprising a fixed counter force frame 20 and a sliding counter force framework 22. As depicted by the figures, it will be known that the fixed vertical guidance framework 16 can be merged with the fixed counter force framework 20 in order to provide one uniform fixed frame for both the vertical sliding gate 18 and the sliding spring framework 22.

As depicted in FIG. 2, the vertical sliding gate 18 slides within the path of motion provided by the fixed vertical guidance framework 16 with a path of motion from a default, closed position to a downward, open position. The sliding counter force framework 22 is configured to operably slide within the path of motion provided by the fixed counter force framework 20 and is operably connected to the vertical sliding gate 18, accordingly the sliding spring framework 22 and the vertical sliding gate 18 move within their respective paths of motion concurrently. One or more elastic means or springs 24 operably connect the sliding counter force framework 22 with the fixed counter force framework 20 in order to provide a resistive counter force opposite to an applied downward force to the vertical sliding gate 18 and the weight of the vertical sliding gate 18. This ensures that the vertical sliding gate 18 returns to the default, closed position when the application of the downward force is removed.

Figure 3:
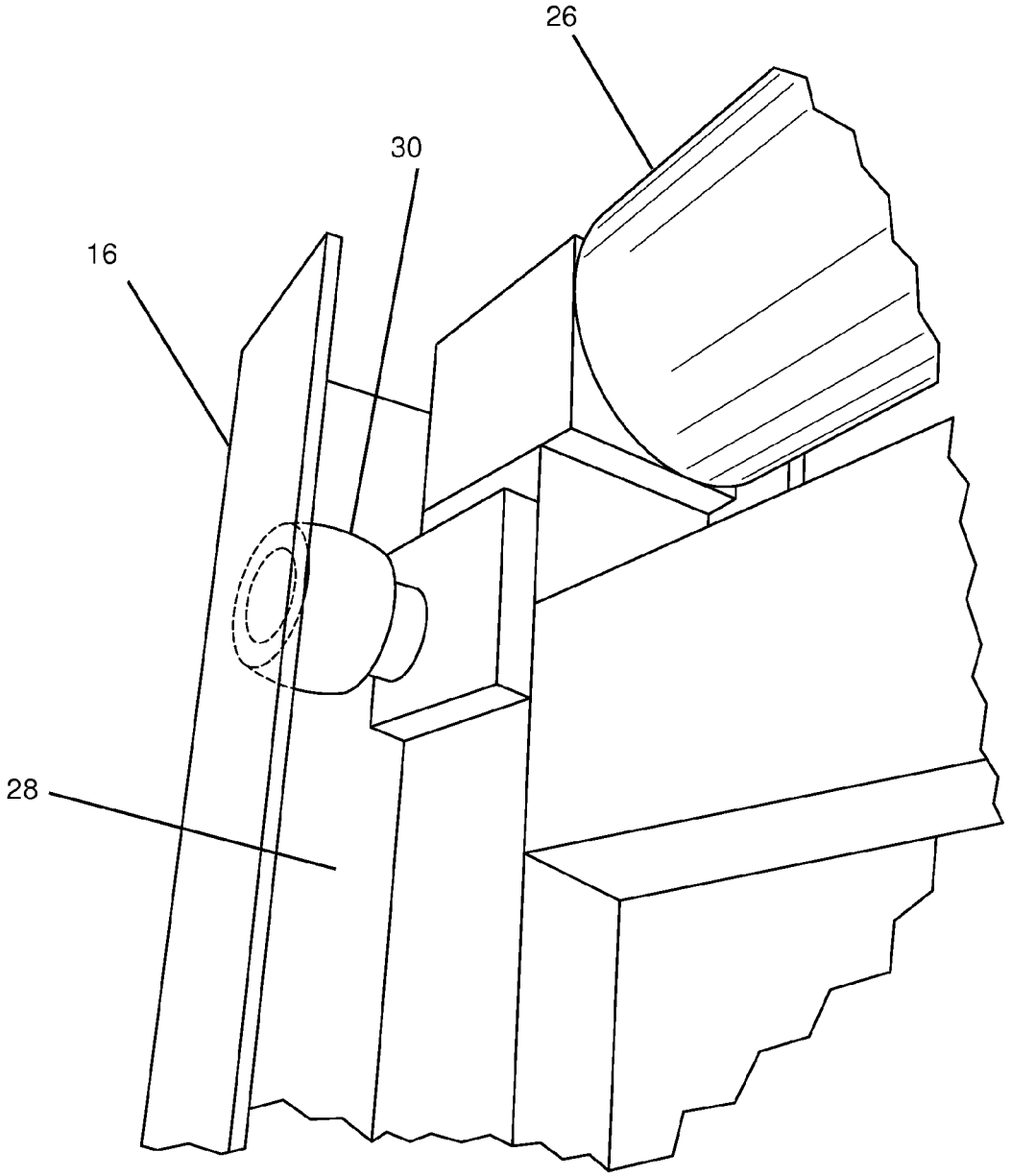
FIG. 3 is an up-close perspective view of the vertical sliding gate with cam roller operable to the fixed vertical guidance framework.

The vertical sliding gate 18 is a solid framed rectangular gate preferably made of steel or other form of metal. The vertical sliding gate 18 is constructed in a manner that is sturdy and safe to lean on and provides a barrier while in the default, closed position. While in the default position, the downward resistive force provided by the one or more springs 24 is sufficient to meet or exceed hand rail standards, thus providing a safe, sturdy and reliable barrier which people can lean on and push down on without the vertical sliding gate moving downward. As depicted by FIG. 3, the vertical sliding gate 18 slides within the same plane as the fixed vertical guidance framework 16 by one or more conveyor rollers 30 adapted to roll within the channel 28 of the fixed vertical guidance framework 16. It will be known that other means for guidance can be used such as plastic wear pads as an alternative to the conveyor rollers 30. This ensures that the vertical sliding gate 18 is square and moves through the path of motion in a balanced and efficient manner.

Figure 4:
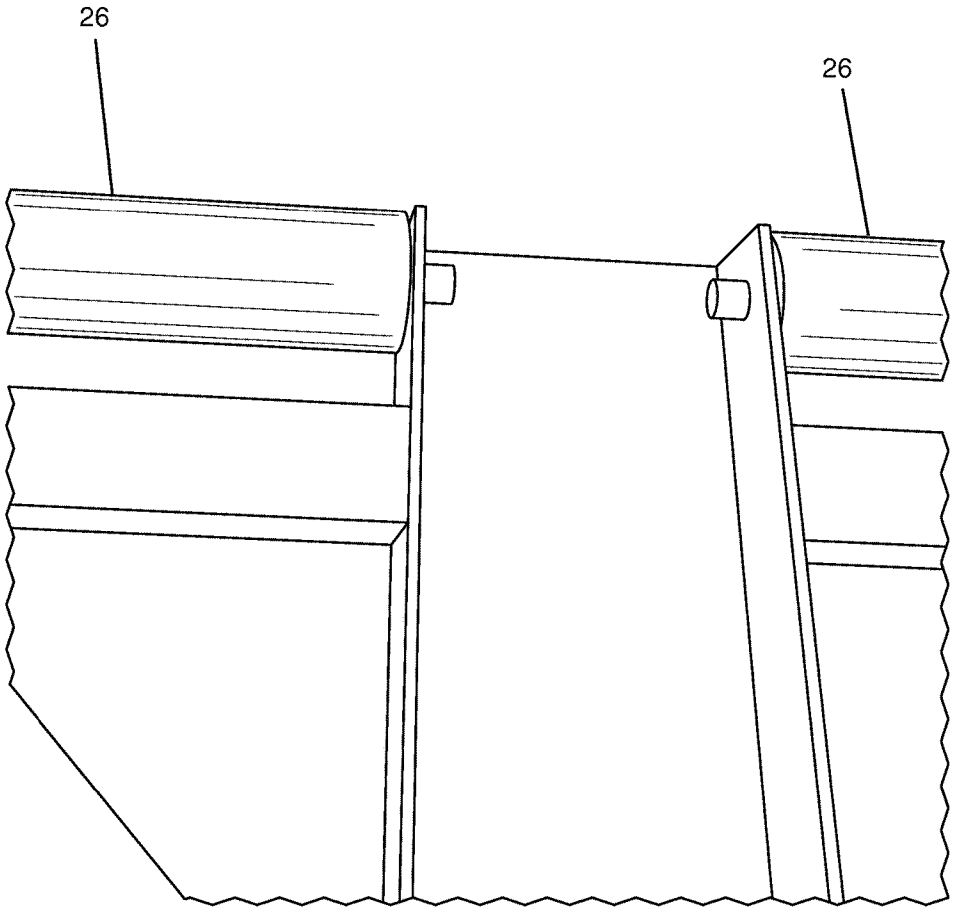
FIG. 4 is an up-close perspective view of the fork lift rollers operably connected to the vertical sliding gate.

As depicted by the figures, particularly FIG. 4, it is preferable that the vertical sliding gate 18 further comprises one or more fork lift rollers 26. The one or more fork lift rollers 26 roll forwards and backward when the forks of a fork lift move forward and back over the top of vertical sliding gate 18 during operation which will be further described below. A lock may be provided which locks the vertical sliding gate 18 in the default, closed position, however not critical to the version.

Figure 5:
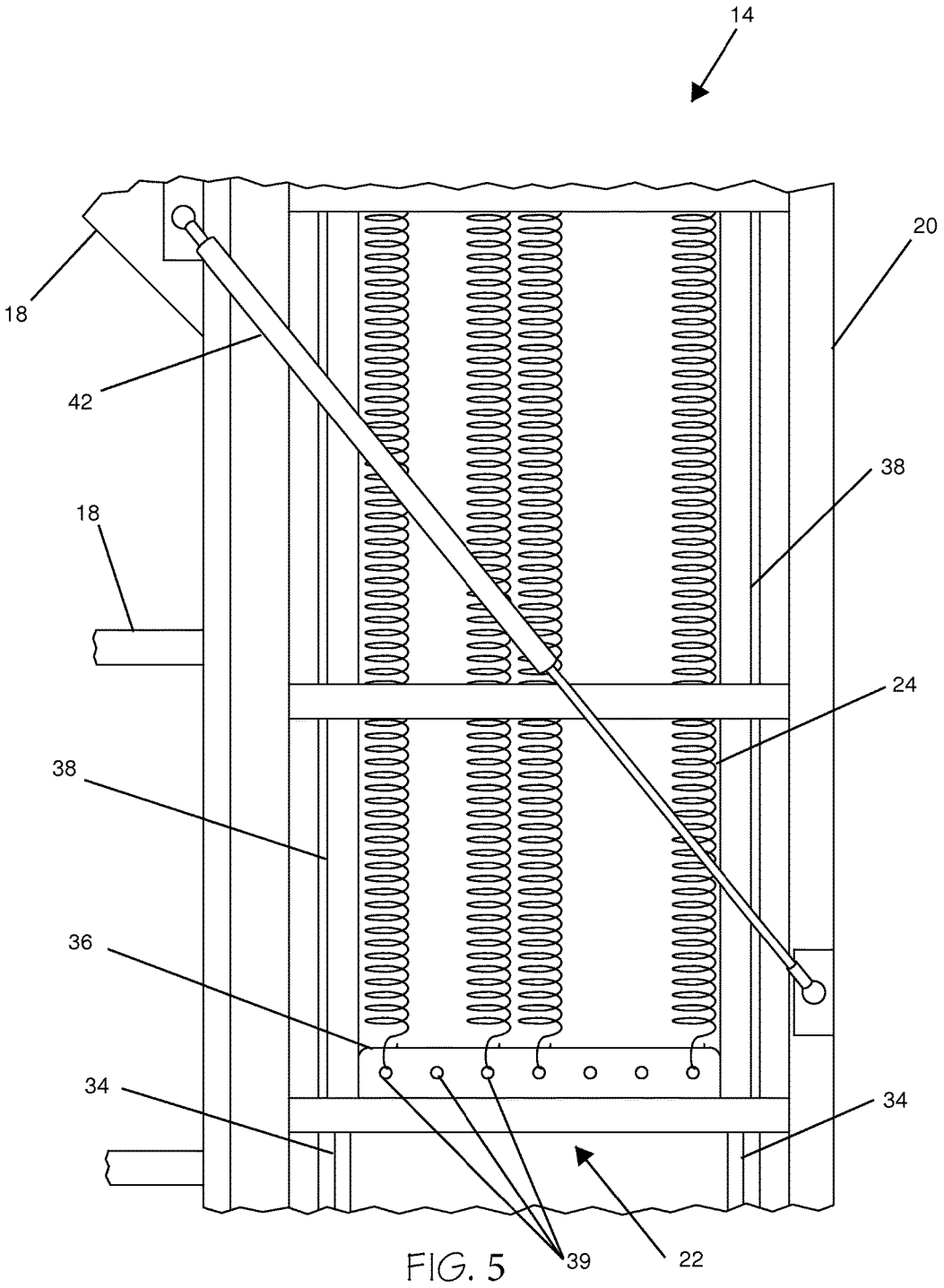
FIG. 5 is an up-close front view of the counter force assembly.
Figure 6:
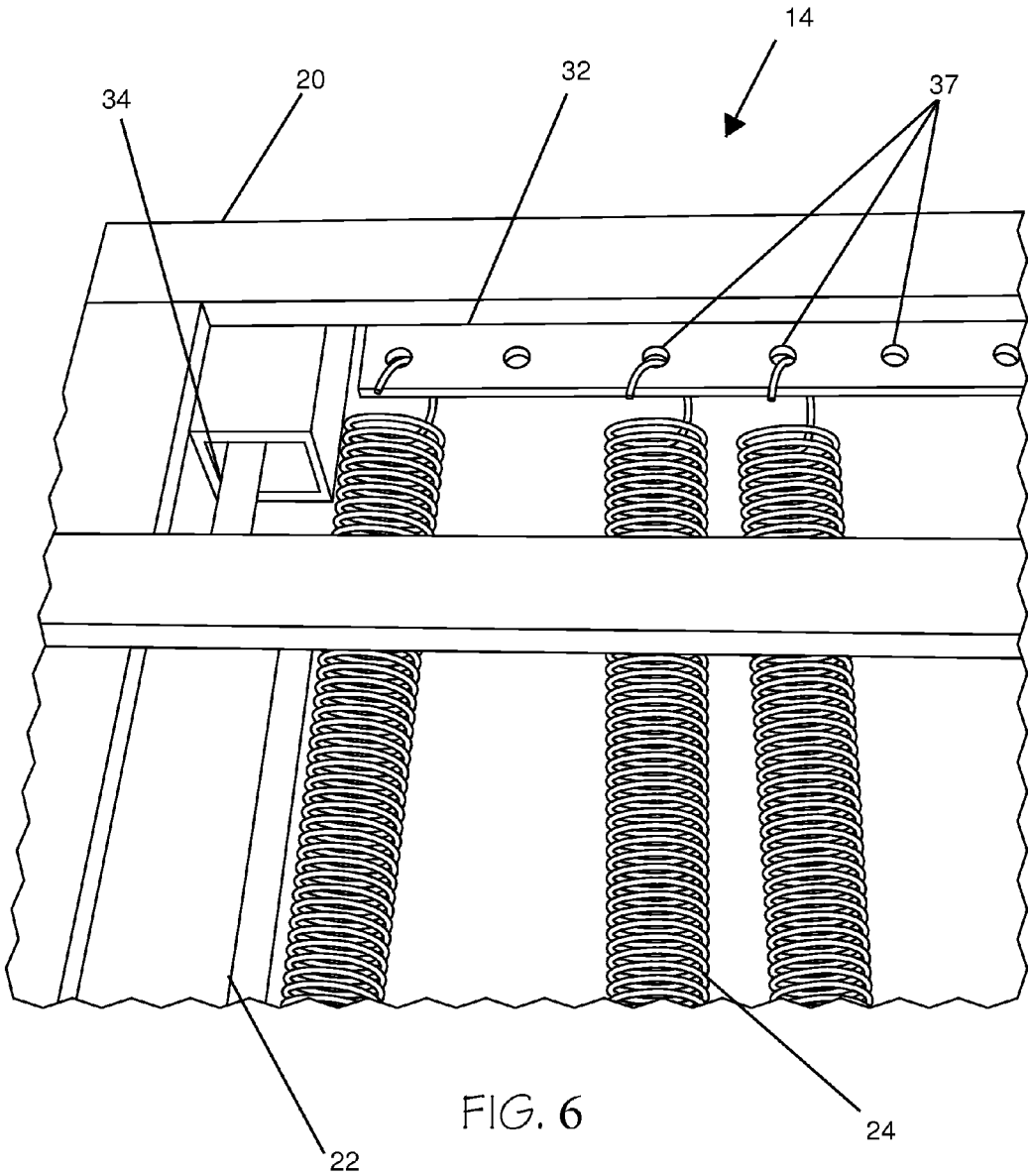
FIG. 6 is an up-close front perspective view of one or more elastic means connected to the fixed counter force framework.
Figure 7:
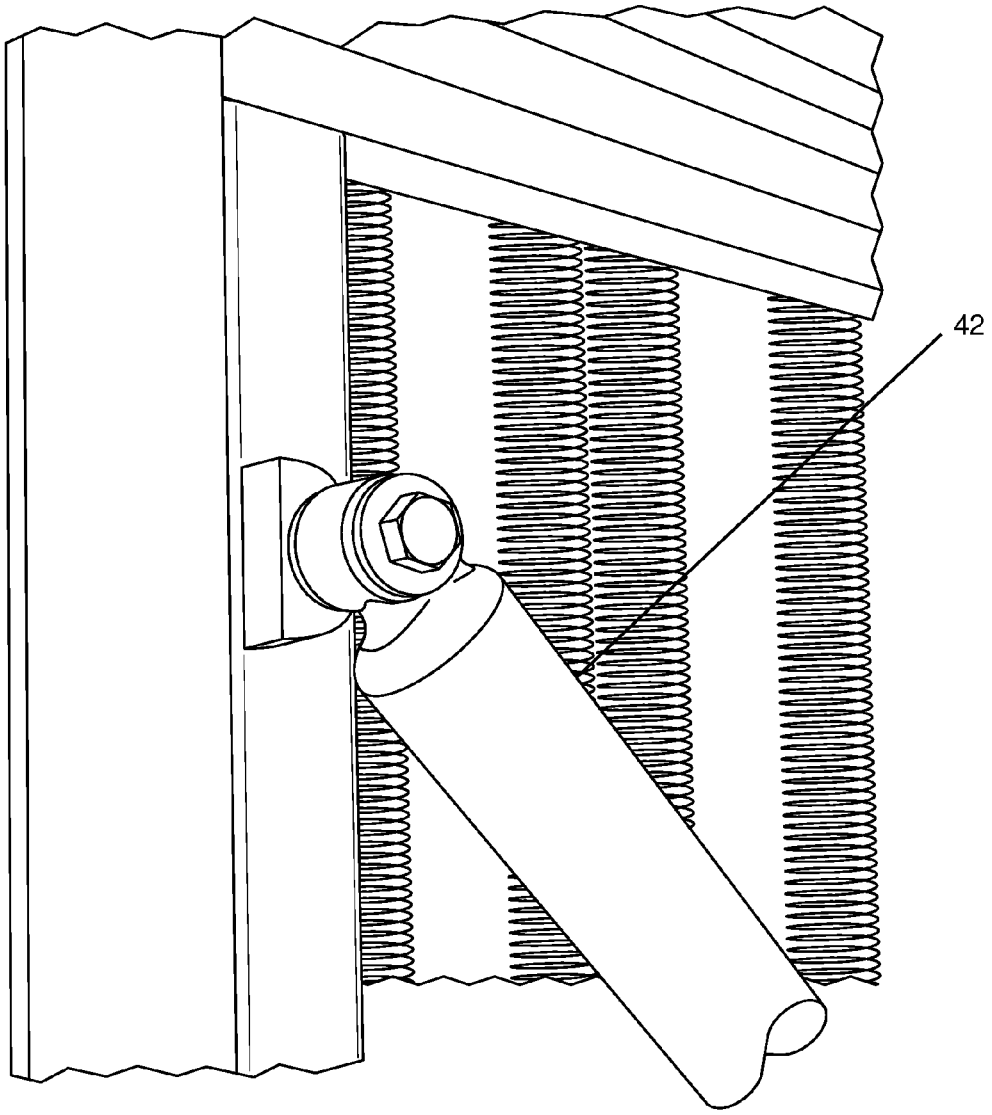
FIG. 7 is an up-close perspective view of the hydraulic dampener.

FIG. 5 and FIG. 6 illustrate the counter force assembly 14 in more detail. The counter force assembly 14 comprises the fixed counter force framework 20 and the sliding counter force framework 22. The sliding counter force framework 22 moves within the same plane as the fixed counter force framework 20 which provides vertical path of motion from a default, closed position to a vertical sliding gate 18 open position. The fixed counter force framework 20 comprises a first elastic means connection member 32 horizontally positioned and a first and second guide rods 34. The sliding counter force framework 22 comprises a second elastic means connection member 36 horizontally positioned, a first and second deck guides 38, and a plurality of cam rollers 36. The first and second deck guides 38 are vertically disposed and are adapted to receive the first and second guide rods 34 for providing the sliding counter force framework 22 a path of operation from the default, closed position to the vertical sliding gate 18 open position. It will be known that a means for guidance such as a plurality of cam rollers or plastic wear pads may be utilized in order to assist and provide the sliding counter force framework 22 balanced movement along the path of motion.

As depicted by the figures, one or more springs or elastic means 24 operably connect the sliding counter force framework 22 with the fixed counter force framework 20 in order to provide a resistive counter force opposite an applied downward force to the vertical sliding gate 18. In the version, the one or more elastic means 24 operably connect to the first elastic means connection member 32 and the second elastic means connection member 36 by a plurality of connection holes 37 and 39 aligned within the connection members 32 and 36 respectively. Moreover, the plurality of connection holes 37 and 39 provide a means for selectively engaging the one or more elastic means 24, whereby a user can selectively change the counter resistive force by engaging or disengaging one or more elastic means 24 between the first elastic means connection member 32 and the second elastic means connection member 36. Therefore, the amount of resistive force can be changed by increasing or decreasing the number of one or more springs or elastic means 24 depending on the size and weight of the vertical sliding gate 18 and desired safety resistance.

Now referring to FIG. 5, a hydraulic Dampener 42 may be utilized in order to dampen the return of the vertical sliding gate 18 to the default, closed position. In a version, the hydraulic dampener 42 is hingedly connected near the top of the vertical sliding gate 18 at an angle to near the bottom of the fixed counter force framework 20. The hydraulic dampener 42 provides a resistive force when the vertical sliding gate 18 is moved downward as well as providing a dampening resistive force when the vertical sliding gate 18 is released moving back into the default, closed position. This ensures that the vertical sliding gate 18 gently returns to the default, closed position in a yielding manner that will ensure the vertical sliding gate 18 longevity and unhindered operation.

Now referring to FIG. 8A-FIG. 8E, the method and operation of the version will be described in detail.

Figure 8A:
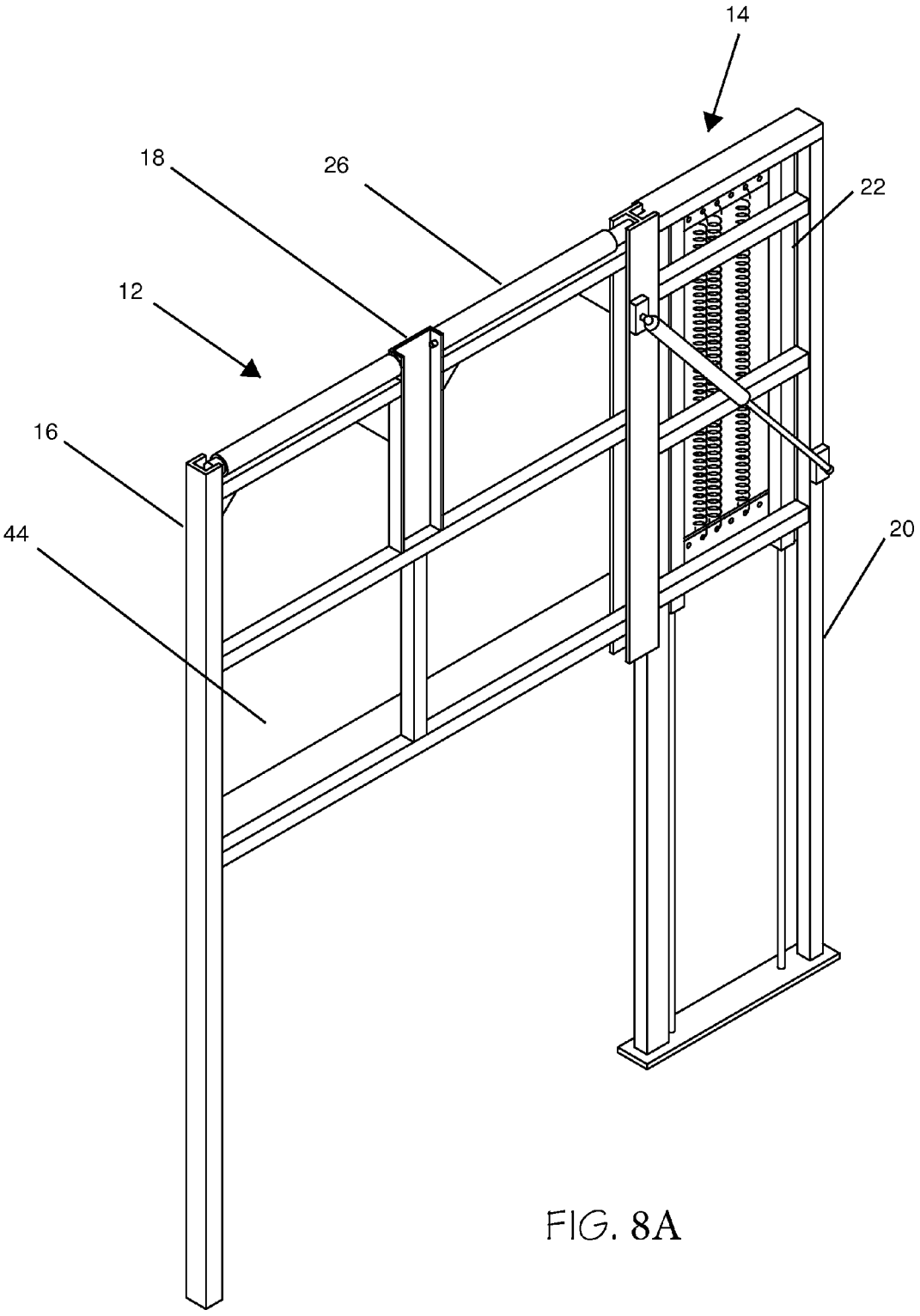
FIG. 8A is an illustrative perspective view of the vertical sliding gate in the default, upward position.

FIG. 8A is an illustrative perspective view of the vertical sliding gate 18 in the default, closed position. While in this position the vertical sliding gate 18 is sturdy and provides a safe barrier between the elevated platform 44 and the open space to the floor area.

Figure 8B:
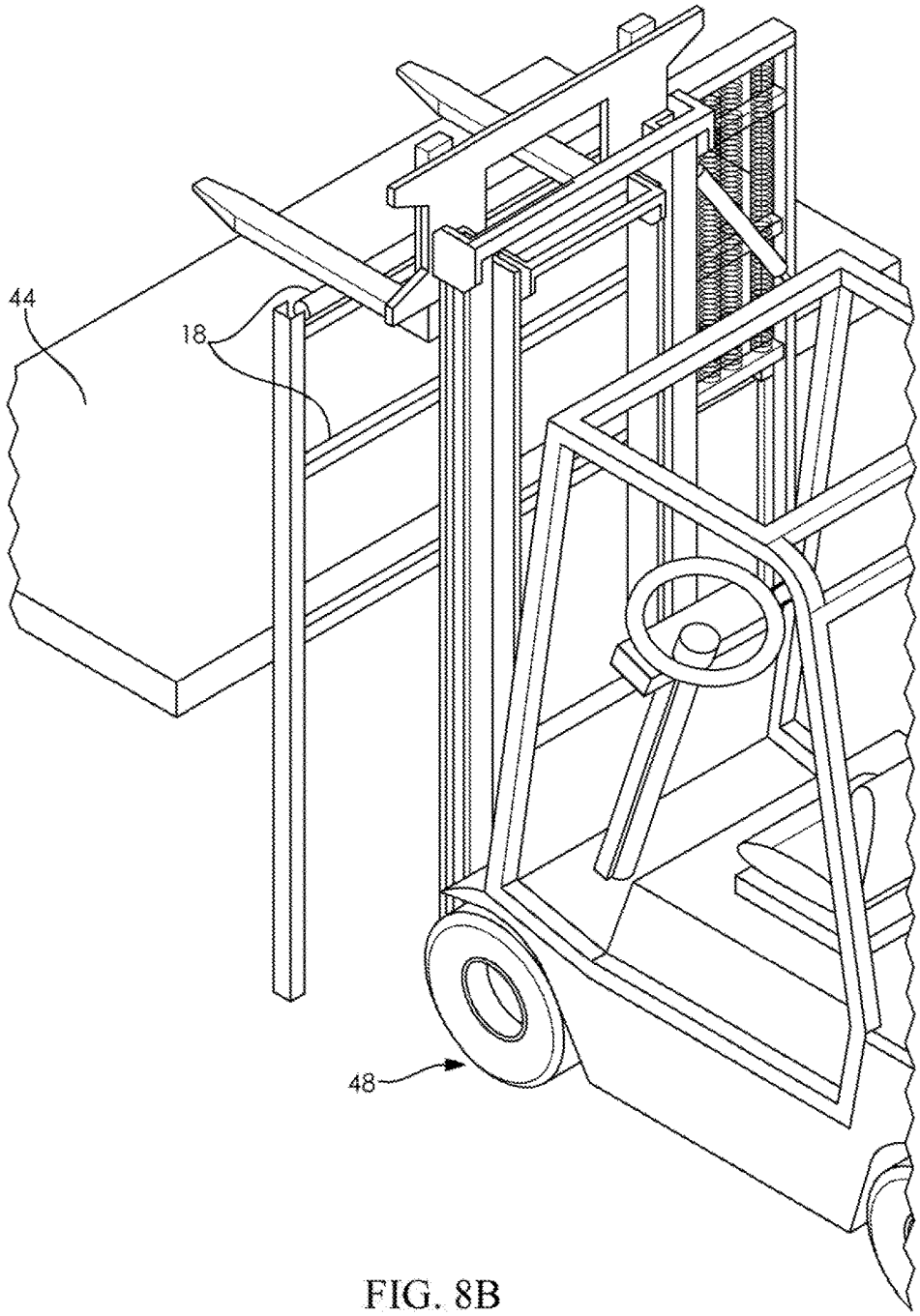
FIG. 8B is an illustrative perspective view of a fork lift preparing to open the vertical sliding gate.
Figure 8C:
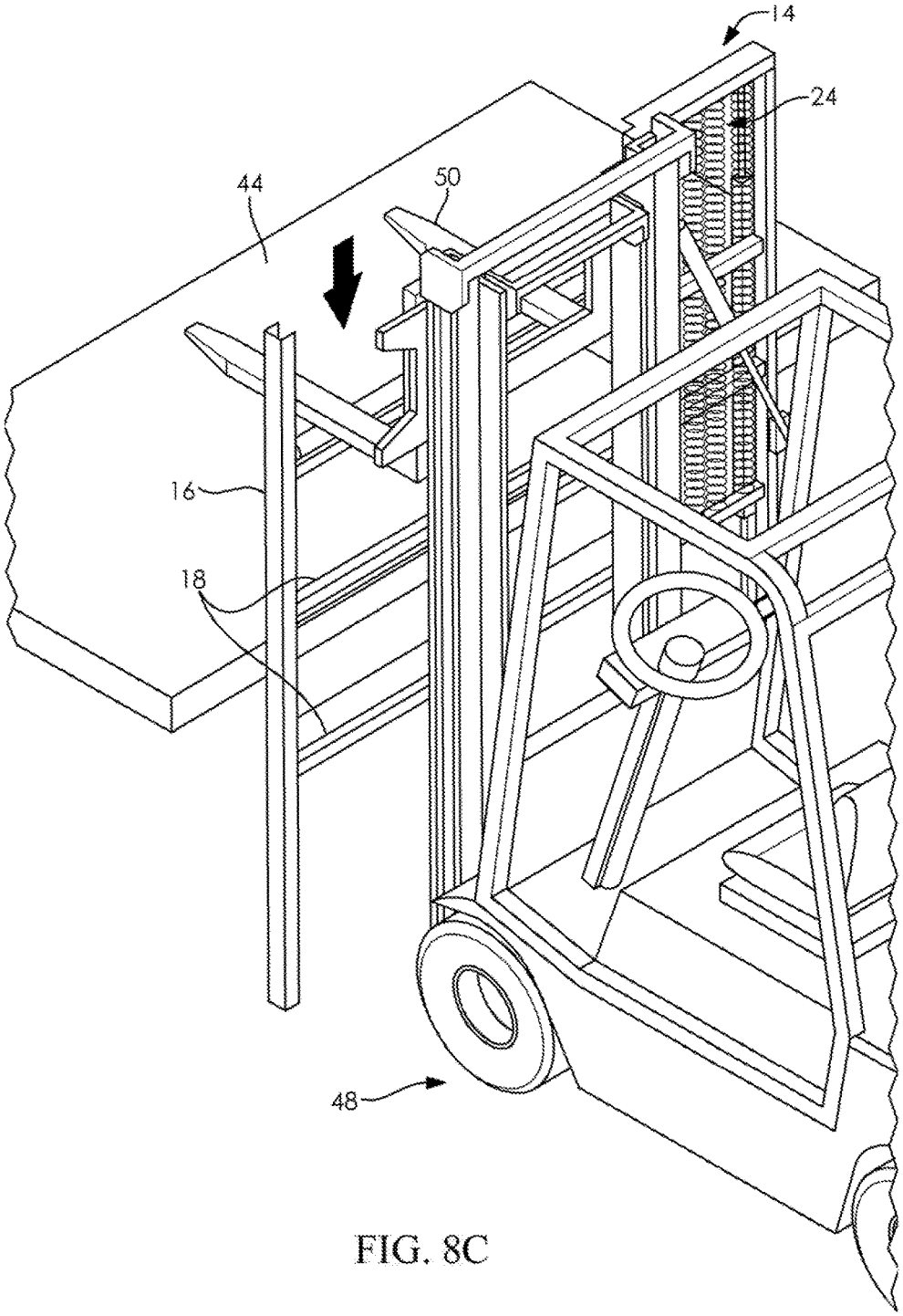
FIG. 8C is an illustrative perspective view of the fork lift applying a downward force to the vertical sliding gate.

FIG. 8B is an illustrative perspective view of the fork lift 48 preparing to open the vertical sliding gate 18;

FIG. 8C illustrates the fork lift 48 applying a downward force by the forks 48 to the vertical sliding gate 18. This downward force overcomes the resistive force created by the counter force assembly 14 having the one or more springs or elastic means 24. Thus, providing a downward movement to the vertical sliding gate 18.

Figure 8D:
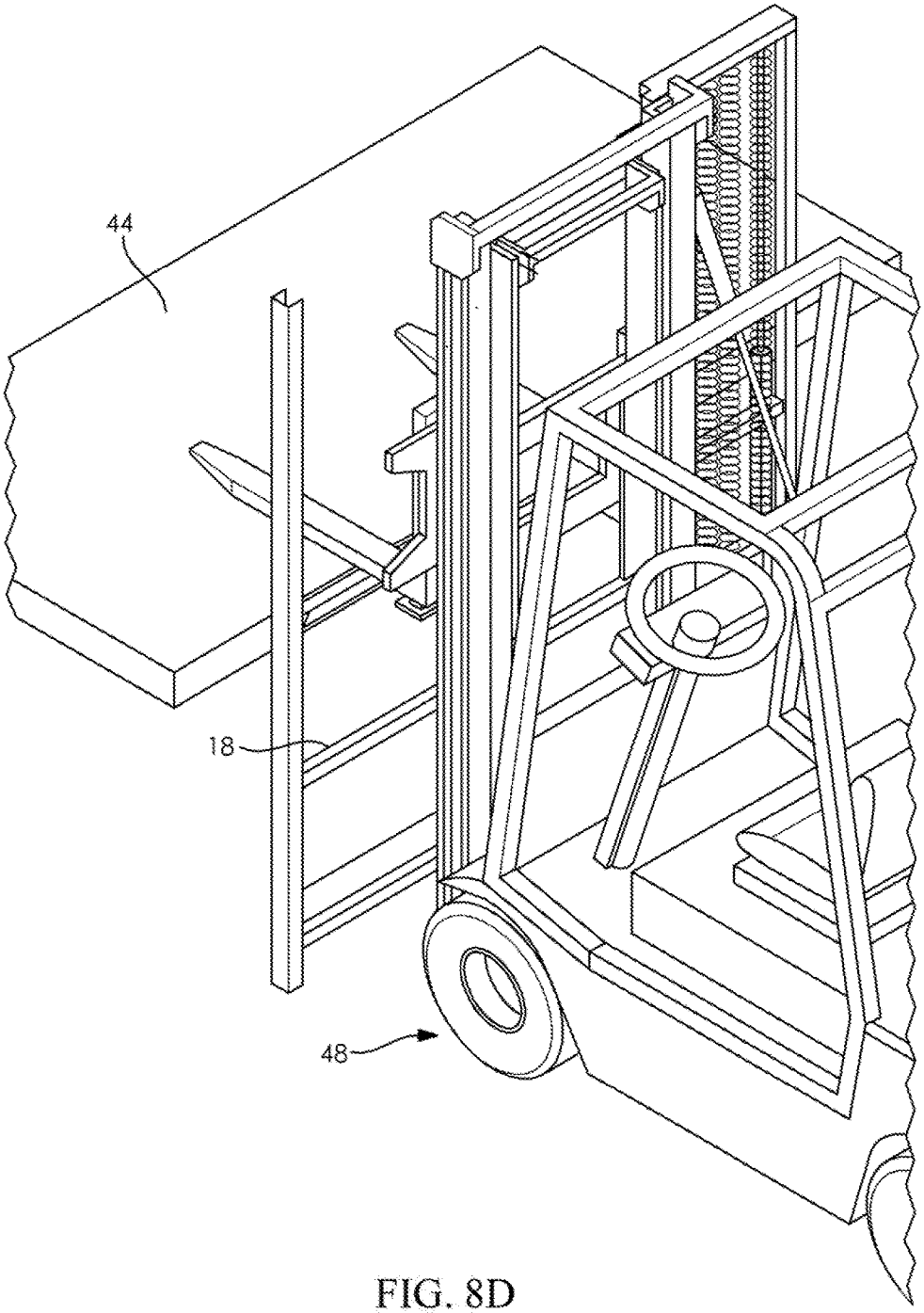
FIG. 8D is an illustrative perspective view of the vertical sliding gate in the open, downward position.

FIG. 8D illustrates the vertical sliding gate 18 in the open, downward position. This enables the fork lift 48 to deliver its load to the platform 44 while the vertical sliding gate 18 is in the open position.

After the load has been removed from the fork lift 48, the fork lift 48 is then backed up away from the open vertical sliding gate 18, which is still in the open position. During the fork lift 48 removal process, the forks 50 smoothly pass over the fork lift rollers 26.

Figure 8E:
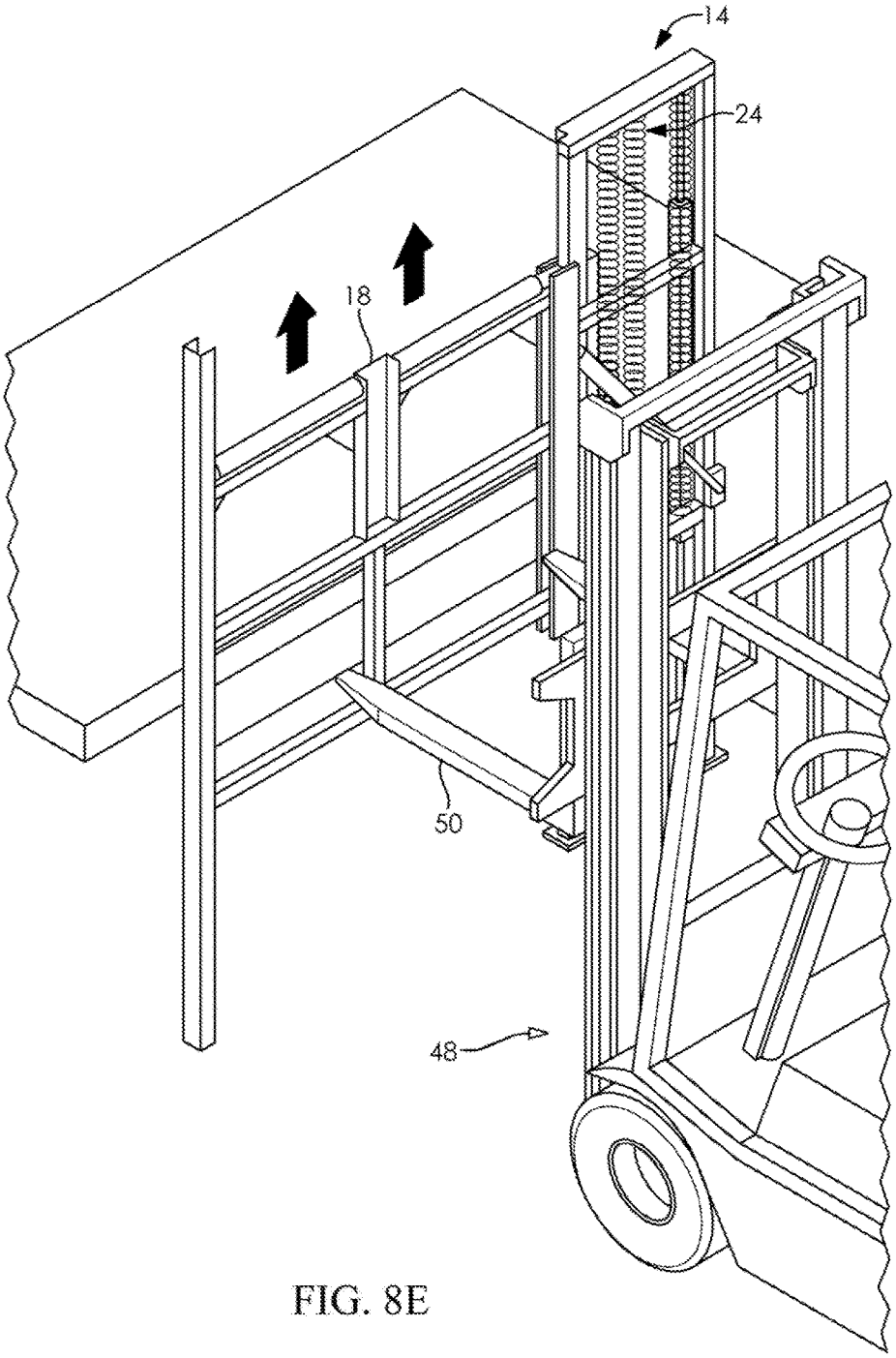
FIG. 8E is an illustrative perspective view of the fork lift removing the forks from applying a downward force to the sliding gate; sliding gate moves upward towards the default, closed position.

FIG. 8E illustrates the fork lift 48 removing the forks 50 and disengaging the downward force applied to the vertical sliding gate 18. In tum, the vertical sliding gate 18 quickly accelerates upward because of the applied counter force created by the counter force assembly 14 and the one or more springs or elastic means 24. While accelerating back to the default, closed position, the hydraulic dampener 42 provides a decelerating force to the vertical sliding gate 18 near achievement of the default, closed position. Thus, gently reaching the default, closed position as depicted in FIG. 8A.

The present invention can be made in any manner and of any material chosen with sound engineering judgment. Preferably, materials will be strong, lightweight, long lasting, economic, and ergonomic.

The invention does not require that all the advantageous features and all the advantages need to be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A safety gate apparatus configured to be opened by a downward force provided by a fork lift having forks between at least a closed, default position and an open position, comprising:

(a) a gate assembly, comprising:

(i) a fixed vertical guidance framework providing a first vertical path of motion between the closed, default position and the open position, the fixed vertical guidance framework having first and second guide members disposed vertically;

(ii) a vertical sliding gate forming a substantially rectangular wall having a top for preventing persons falling from an elevated platform, wherein the vertical sliding gate slides within the first vertical path of motion between the first and second guide members provided by the fixed vertical guidance framework; and (iii) one or more horizontally positioned fork lift rollers exposed above the top of the vertical sliding gate for engagement with the forks of the fork lift; and (b) a counter force assembly for providing a resistive counter force opposite the downward force applied to the vertical sliding gate by the forks of the forklift while opening the safety gate apparatus, comprising:

(i) a fixed counter force framework providing a second vertical path of motion, wherein the fixed counter force framework comprises a static first connection member;

(ii) a sliding counter force framework configured to operably slide within the second vertical path of motion provided by the fixed counter force framework, the sliding counter force framework comprising a second connection member horizontally positioned below the first connection member, the sliding counter force framework is integrally connected to the vertical sliding gate, wherein the sliding counter force framework and the vertical sliding gate move within their respective paths of motion concurrently; and (iii) a plurality of springs operably connecting the first connection member of the fixed counter force framework with the second connection member at of the sliding counter force framework, the plurality of springs configured to resist movement which imparts a greater distance between the first connection member and the second connection member, thereby providing a resistive counter force opposite the downward force to the vertical sliding gate provided by the fork lift, wherein at least one of the first connection member and the second connection member provide a plurality of openings engaging the plurality of springs, whereby a user can selectively change the resistive counter force by engaging or disengaging the plurality of springs between the first connection member and the second connection member.

2. The safety gate apparatus of claim 1, further comprising a hydraulic dampener operably connecting the vertical sliding gate with the fixed counter force framework, thereby providing a resistive force when the vertical sliding gate is moved downward through the first vertical path of motion or, in the alternative, providing a dampening resistive force when the vertical sliding gate is released from the forks of the fork lift, moving back into the closed, default position.

* * * * *